United States Patent [19]

Diem et al.

[11] Patent Number: 4,914,410

[45] Date of Patent: Apr. 3, 1990

[54] RELAY FOR PRINTED CIRCUIT BOARD

[75] Inventors: Hans A. Diem, Richterswil; Afro Cecchini, Au, both of Switzerland

[73] Assignee: Standard Telephon und Radio AG, Zurich, Switzerland

[21] Appl. No.: 277,200

[22] Filed: Nov. 29, 1988

[30] Foreign Application Priority Data

Nov. 30, 1987 [CH] Switzerland ..... 04650/87

[51] Int. Cl.[4] ..... H01H 51/22

[52] U.S. Cl. ..... 335/80; 335/128; 335/126

[58] Field of Search ..... 335/78–83, 335/128, 124–126

[56] References Cited

U.S. PATENT DOCUMENTS 4,122,420 10/1978 Brown ..... 335/80

4,514,711 4/1985 Nagamoto et al. ..... 335/274

*Primary Examiner*—Leo P. Picard

*Assistant Examiner*—L. Donovan

*Attorney, Agent, or Firm*—Spencer & Frank

[57] ABSTRACT

With a very small hinged armature relay of the printed circuit board type with dual-in-line terminal configuration intended for a very high number of actuations there exists the problem to design the armature resetting spring in such a manner that it withstands said high number of actuations without any risk of failure. For the present relay this problem has been solved by providing a leaf spring as the armature resetting spring being connected in a form-locking manner to the legs of a U-shaped armature (13) extending substantially in parallel to said legs and being connected in a force-locking manner to the coil former (10) constituting the relay structure, this in contrary to the usual way wherein said flat spring would be connected to the legs of the E-shaped magnet yoke (12). By this means it is possible to provide the leaf spring with a length at least equal to the length of the legs of the armature. To facilitate the manufacture and handling the leaf springs of the individual legs are interconnected by a crosspiece to an integral H-shaped flat spring (14).

5 Claims, 3 Drawing Sheets

RELAY FOR PRINTED CIRCUIT BOARD

REERENCE TO RELATED APPLICATIONS

The present disclosure relates to the subject matter disclosed in Swiss Application 04650/87-3 of Nov. 30th, 1987, the entire specification of which is incorporated herein by reference.

BACKGROUND OF THE INVENTION

The present invention relates to a relay for printed circuit boards with dual-in-line terminal configuration comprising a coil former constituting the relay structure, an E-shaped magnet yoke, a U-shaped armature, a slider to transmit the armature motion to contacts arranged in a plane parallel to that of the magnet circuit, and a hermetically sealed housing.

There is known a large number of relays for printed circuit boards all of which do not exceed a given height above the printed circuit board to allow for the arrangement of printed circuit boards having relays mounted thereon with a given mutal distance. Such a relay is manufactured and sold by the applicant under the trade name "MT 2". This relay is desscribed in full details by W. Kälin in "MT-Relais-ein Leiterplattenrelais mit dual-in-line-Anschlussbelegung", published in "STR-Report" Vol. 5, No. 2, November 1984.

This relay is provided with two change-over contacts of given data and is designed for low power consumption by the coil in order to be used as an output stage of integrated circuits.

If a relay similar to the above relay, but having four change-over contacts of the same data is utilized, the doubling of the number of contacts leads substantially to a doubling of the power consumption of the coil thus a redesign of the magnet circuit is needed. As the height above the printed circuit board is limited for reasons already mentioned and the height is fully utilized by the above known relay, it is not possible to enlarge the scale of the magnet circuit of this relay.

SUMMARY OF THE INVENTION

It is an object of the present invention to provide a relay of the above kind for printed circuit boards having four change-over contacts, having about the same power consumption of the coil per contact as the known relay, having a structural height not exceeding that of the known relay and being so designed that a automated manufacture is possible.

The relay according to the invention is characterized in that four change-over contacts are arranged side by side, that the legs of the armature overlap the corresponding legs of the magnet yoke by at least half their length, that for resetting the armature one end of a biased leaf spring is connected to each one of the two legs of the armature the other end of which is connected to the coil former, and that the length of the leaf spring is at least equal to the length of the leg of the armature connected thereto.

BRIEF DESCRIPTION OF THE DRAWINGS

The invention will be best understood from the following description of an embodiment of the invention taken in conjunction with the accompanying drawings in which.

DETAILED DESCRIPTION OF A PREFERRED EMBODIMENT

The relay illustrated is a hinged armature relay for printed circuit boards as the relay described by Kalin and is provided with dual-in-line terminal configuration, i.e. the terminals are arranged at the bottom of a rectangular parallelpiped along its longer sides with standardized spaces both between the two rows of terminals and between the individual terminals.

Figure 1:
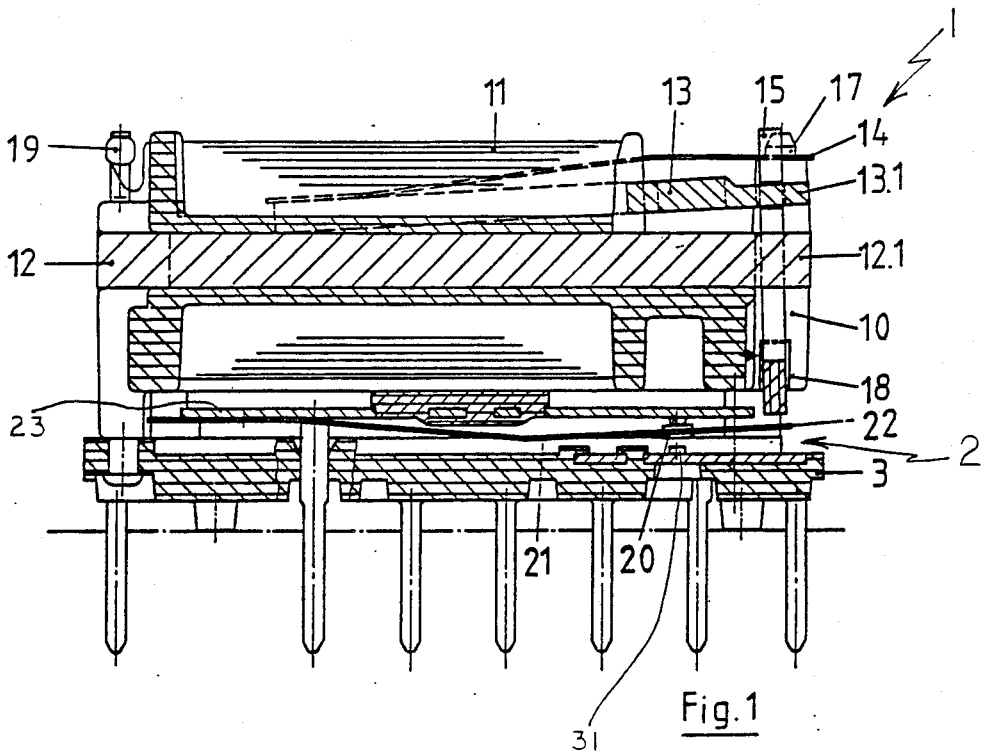
FIG. 1 is a vertical section through a relay taken along the axis of the coil.

FIG. 1 shows a vertical section through the relay according to the invention taken along the axis of its coil 11. As it can be seen therefrom the present relay comprises substantially three main portions, namely an actuating system 1, a contact spring system 2 and a relay bottom 3. There is not shown a cuboidlike cover to hermetically seal the relay in order to maintain well defined conditions for the contacts during the whole lifetime of the relay. The hermetical sealing of the gaps between the cover and the relay bottom 3 and of the terminals in the relay bottom can be performed with the aid of a curing resin being applied to two points of the relay bottom and being distributed via suited channels at the relay bottom under capillary action as described in Swiss Pat. No. 625 381 (Case W. W. Frey 5).

Figure 2:
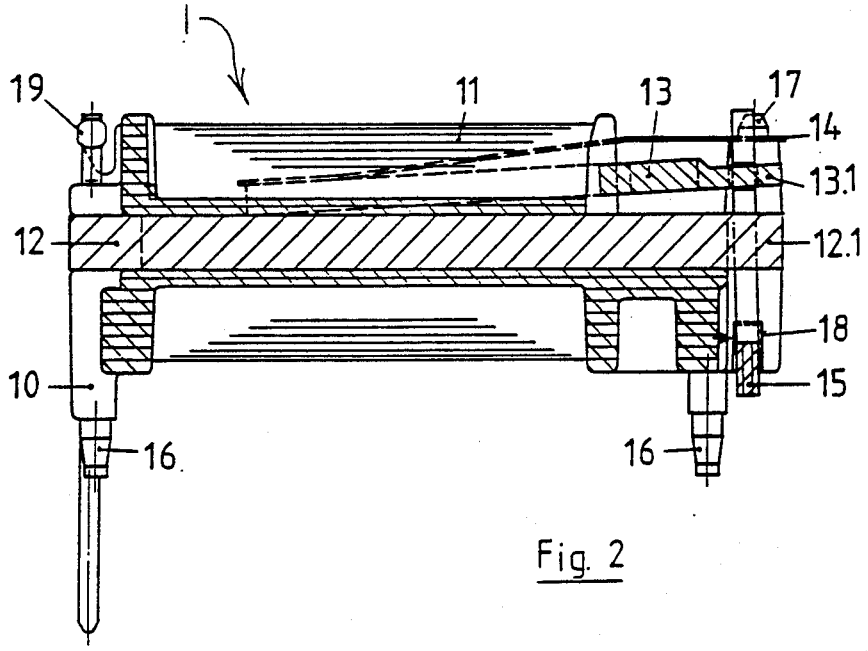
FIG. 2 is a vertical section similar to that of FIG. 1, but limited to the actuating system of the relay.

The actuating system 1 of FIG. 2 shown prior to the assembly with the contact spring system 2 and the relay bottom 3 consists of a coil 11 wound onto a coil former 10, an E-shaped magnet yoke 12 and a U-shaped armature 13 which is supported by a leaf spring 14 acting as the armature resetting spring and being connected to a slider 15 in a form-locking manner which slider transmits the armature motion to the contacts. The coil former 10 constitutes the actual structure of the relay as it receives besides the coil 11 the middle leg of the magnet yoke 12, it guides with the aid of recesses 18 the slider 15 and limits the slider 15 motion and therewith the motion of the armature 13, it defines abutment faces for the spring system 2, it possesses stublike projections 16 at the lower side for positioning and supporting the relay bottom 3 with intermediate spring system 2 and it is provided at the upper side with stublike projections 17 for positioning and attaching the leaf spring 14. Further there are supportedby the coil former 10 terminals 19 to the upper ends of which the wire ends of the coil 11 will be connected. After the winding operation said upper ends will be bent toward the coil axis to provide a pull-relief loop of said wire ends as it can be seen from FIGS. 3 and 4.

The present relay is provided with four change-over contacts arranged side by side one of which is shown in FIG. 1 in a section view and the structure of which is similar to that of the two contacts of the already mentioned known relay. The spring system 2 of the present relay is provided with only one plastic molded piece 23 supporting the break contacts 20 and the change-over springs 21 and their terminals whereas the make contacts 31 and their terminals are supported by the relay bottom 3. This has the advantage of a reduction of the number of pieces to be assembled by one piece. Due to the use of guide pins and bushings, a pre-assembly of spring system 2 and relay bottom 3 is possible, resulting into a contact assembly testable in advance. As already mentioned the present relay is broader than the known relay, but has the same length so that the mutual distance of the terminals is half that of the known relay.

Figure 3:
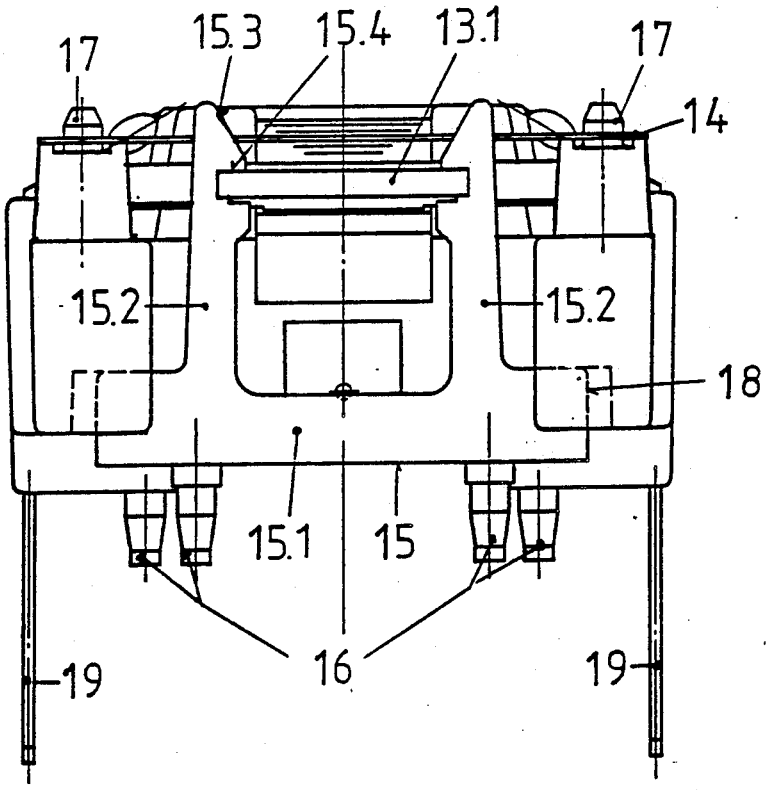
FIG. 3 is a front plan view of the actuating system of the relay of FIG. 1.
Figure 4:
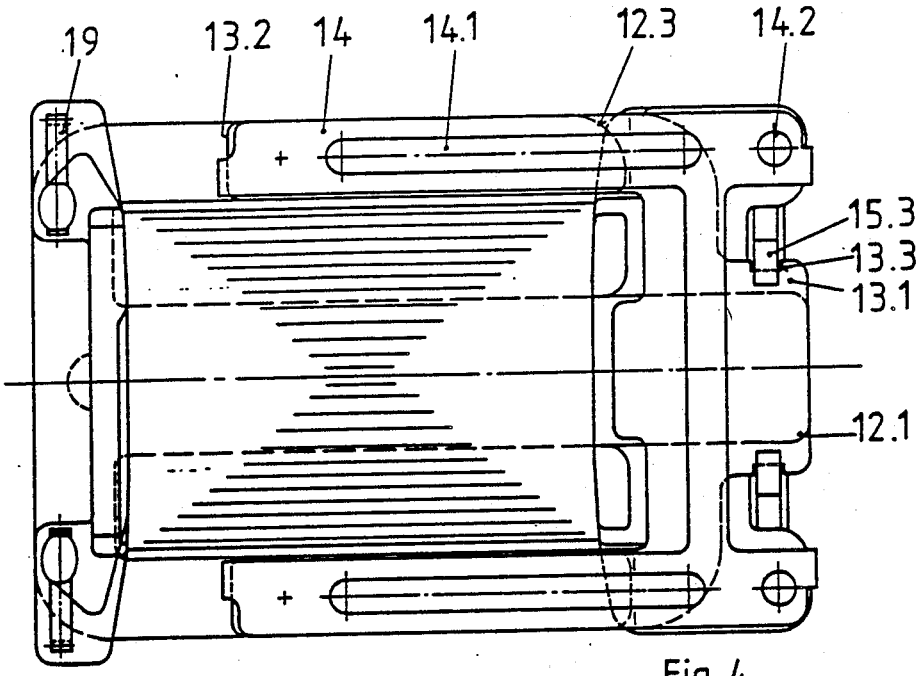
FIG. 4 is a top plan view of the relay.
Figure 5:
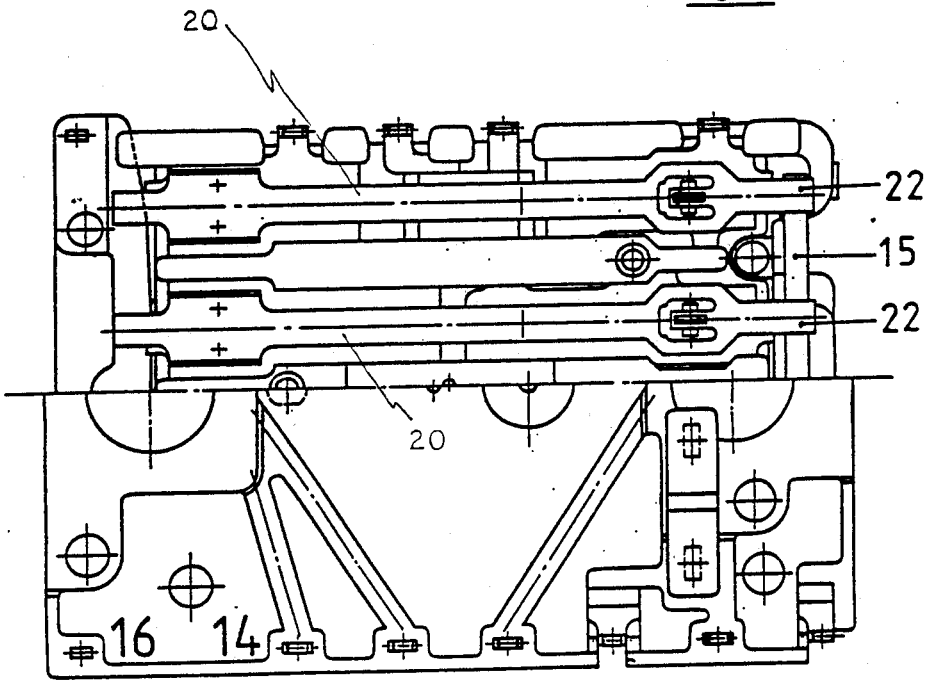
FIG. 5 is a bottom view of the relay with partially cut away bottom wall.

The movable ends 22 of the change-oer springs 21 are moved by said slider 15 from their rest position into the working position when the relay is excited. The shape of the slider 15 can be seen from FIG. 3. Two arms 15.2 extend upwards from a crosspiece 15.1 the lower edge of which works up on the four change-over springs 20 two of which are illustrated in FIG. 5. Said arms are provided at their upper inner ends with chamferings 15.3 having adjacent thereto recesses 15.4 of such a shape that a projection 13.1 of the armature can be snapped onto the slider 15 under the spring action of the arms 15.2. In order to maintain the position of the slider 15 on the projection 13.1 of the armature 13 said projection is also provided with recesses 13.3 shown in FIG. 4. The crosspiece 15.1 of the slider 15 is guided at both of its ends by recesses 18 of the coil former 10 (FIGS. 1 and 3). The shape of said recesses is such that they are functioning to limit the armature stroke with released relay.

As already mentioned the armature 13 is supported with the aid of a leaf spring 14. Said leaf spring is substantially H-shaped with shortened upper legs as it can be seen from FIG. 4. The two perpendicular legs only of the H are used for the relay function whereas the crosspiece serves to facilitate the manufacture and assembly, i.e. it would also be possible to use two individual indentical leaf springs. As it can be seen from FIGS. 1 and 2 the two legs of the leaf springs 14 used for the relay function are connected at one end in a usual manner to the corresponding legs of the armature, but the other ends are not connected to the two outer legs of the E-shaped yoke 12, as usual in the prior art, but they are connected to stublike projections 17 of the coil former 10. To that end said other ends of the legs of the leaf spring 14 are provided with holes 14.2 in order to be pressed onto the stublike projections 17 so that a force-locking connection between leaf spring 14 and projection 17 results whereby the tappered portions of said projections are used to facilitate the insertion and may be transformed after the pressing operation into rivet heads so that form-locking connections are achieved additionally. As it can be seen from the drawing the legs of the leaf spring 14 have about the same length as the legs of the armature 13 including the projection 13.1. This design allows, on the one hand, to have long legs of the armature 13 overlapping the corresponding legs of the yoke 12 over about $\frac{2}{3}$ of their lenth leading to a low magnetic resistance of the magnet circuit yoke/armature and, on the other hand, to have at the same time long legs of the leaf spring 15 leading to a low mechanical load and thus to the required high number of actuations of the relay without the risk of a failure of the spring.

As it can be seen from the drawing, the leaf spring 14 is bent to bias the spring. The position of this bending and the amount of biasing are chosen in such a manner that the pressure of the edge 13.2 of the armature 13 onto the legs of the yoke 12 with released relay is a minimum and the resetting force acting upon the armature is high enough to withstand to a shock of a given amount without the armature moving into the actuated position. In order to be able to use a spring material of a greater thickness the legs of the leaf spring 14 are provided with cut-outs 14.1.

What is claimed is:

1. A relay for printed circuit boards with dual-in-line terminal configuration comprising:

a coil former, a magnet yoke having two parallel legs and attached to said coil former, two biased leaf spring attached to said coil former, a U-shaped armature having two parallel legs and movably mounted between said leaf springs and said yoke, a slider attached to said armature for transmitting armature motion to a plurality of contacts including four change-over contacts arranged side by side adjacent said coil former, wherein the legs of the armature overlap the corresponding legs of the magnet yoke by at least half their length, a first end of each of said biased leaf springs is connected to a respective one of the two legs of the armature the other end of each of said leaf springs is connected to the coil former so that each of said leaf springs extends essentially parallel to said respective armature leg, and that the length of each leaf spring is at least equal to the length of the leg of the respective armature connected thereto.

2. A relay according to claim 1, wherein said first end of each of said leaf springs is connected to the armature in a form-locking manner, and that said other end of each of said springs is connected to the coil former in a force-locking manner.

3. A relay according to claim 2, further comprising a crosspiece connecting the two leaf springs to form a one-piece H-shaped spring assembly.

4. A relay according to claim 1, said slider further including resilient arms having chamferings and recesses facing each other, and said armature having a projection with recesses for receipt of said arms of said slider said arms engagable onto the projection of the armature to produce an acting connection between said armature and said slider.

5. A relay according to claim 1, wherein said first end of each of said leaf springs is connected to the armature in a form-locking manner, and that said other end of each of said springs is connected to the coil former in a form-locking manner.

* * * * *